United States Patent [19]

Zommers

[11] Patent Number: 4,665,964

[45] Date of Patent: May 19, 1987

[54] FOLDABLY EXTENSIBLE AND COLLAPSIBLE TRACK-MOUNTED SHADE DEVICE FOR SKYLIGHT-TYPE WINDOW

[76] Inventor: G. Juris Zommers, 459 Shannon Dr., Bainbridge Island, Wash. 98110

[21] Appl. No.: 539,170

[22] Filed: Oct. 5, 1983

[51] Int. Cl.[4] ..... E06B 3/92; A47H 5/032

[52] U.S. Cl. ..... 160/84 R; 160/273 R; 160/276

[58] Field of Search ..... 160/84 R, 115, 273–277, 160/123, 124, 126, 330, 345, 231, 209; 211/105.1, 123, 124; 16/87.4 R, 87.4 W, 93 D, 93 W; 248/257

[56] References Cited

U.S. PATENT DOCUMENTS

| | | | |
|---|---|---|---|
| 236,126 | 12/1880 | Washburn | 160/276 |
| 604,329 | 5/1898 | Judge | 160/115 |
| 1,728,074 | 9/1929 | Nicholas | 160/84 R |
| 1,899,062 | 2/1933 | Steffen | 160/84 R |
| 2,031,157 | 2/1936 | Gilson | 160/84 R |
| 2,118,474 | 5/1938 | Morton | 160/84 R |
| 2,698,455 | 1/1955 | McMurray | 16/87.4 R |
| 2,934,782 | 5/1960 | Wootton | 16/93 D |
| 3,315,727 | 4/1967 | Clark | 160/84 R |
| 3,481,073 | 12/1969 | Yoshida et al. | 160/84 R |
| 3,951,196 | 4/1976 | Salzmann | 160/345 |

FOREIGN PATENT DOCUMENTS

| | | | |
|---|---|---|---|
| 524842 | 8/1940 | United Kingdom | 160/345 |
| 533128 | 2/1941 | United Kingdom | 160/84 R |
| 614881 | 12/1948 | United Kingdom | 248/251 |
| 1554159 | 10/1979 | United Kingdom | 160/84 R |
| 2040679 | 9/1980 | United Kingdom | 211/105.1 |

*Primary Examiner*—Ramon S. Britts
*Assistant Examiner*—Cherney S. Lieberman

[57] ABSTRACT

The device comprises a foldably extensible and collapsible shade member, and means for forming corresponding sets of laterally projecting trunnions at spaced intervals along opposing edges of the shade member. It also comprises a pair of elongated track defining members which are adapted to be mounted on opposing sides of the window frame so that tracks thereof are oppositely disposed to one another across the frame. The track defining members have opposing sets of carrier elements slidably engaged on the respective tracks thereof, which are adapted to support the trunnions of the shade member on spaced parallel axes extending crosswise the sides of the frame. In addition, there are means for extending and retracting the shade member when the trunnions thereof are supported on the sets of carrier elements, and means whereby the respective sets of carrier elements and trunnions can reciprocate in relation to one another along the aforesaid axes when the shade member is extended and retracted thereon.

8 Claims, 15 Drawing Figures

Fig. 14
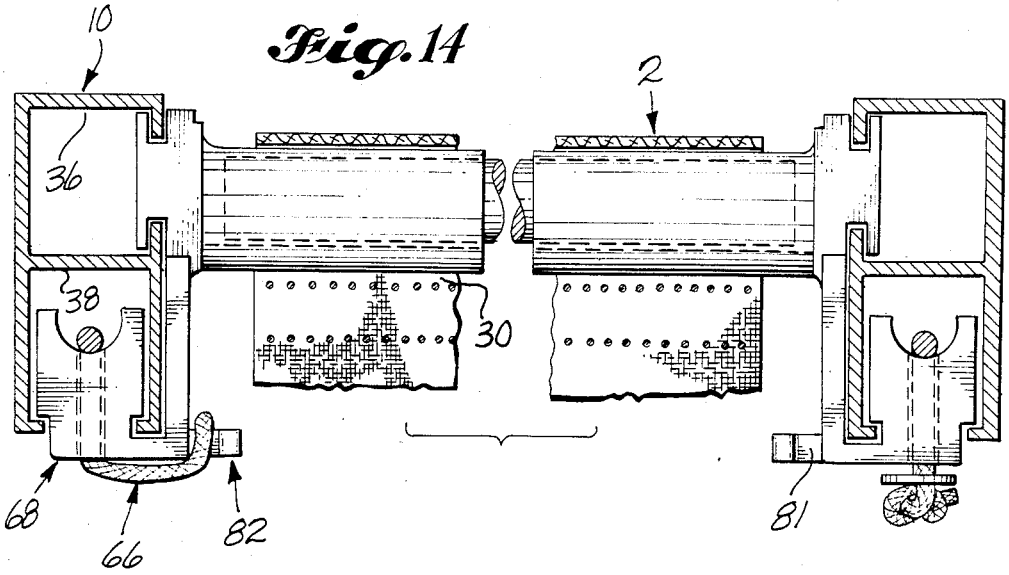
Fig. 15
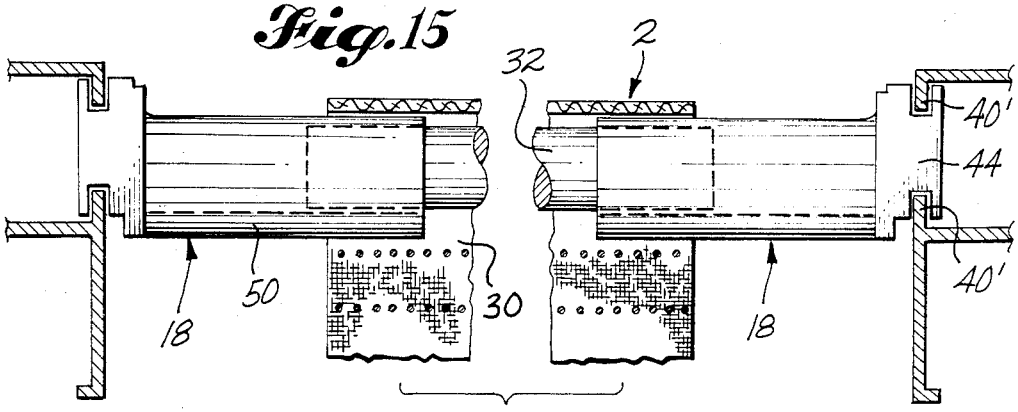
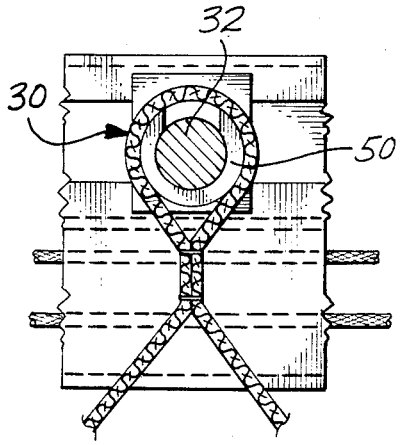
Fig. 12
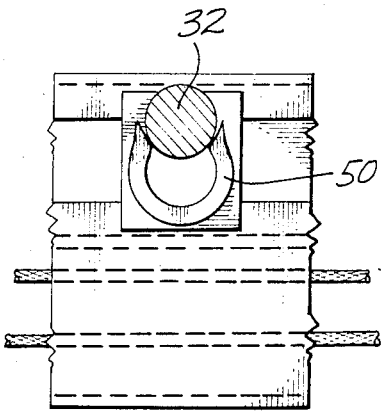
Fig. 13

FOLDABLY EXTENSIBLE AND COLLAPSIBLE TRACK-MOUNTED SHADE DEVICE FOR SKYLIGHT-TYPE WINDOW

THE INVENTION IN GENERAL

This invention relates to a foldably extensible and collapsible track mounted shade device for windows and particularly for skylight-type windows.

Skylights are a form of overhead window which often has large dimensions between the respective sides and ends thereof. Moreover, the window also has a surrounding frame which because of its size, may be out of parallel when a foldably extensible and collapsible track mounted shade device is installed on the same to control the flow of light through the window. Therefore, the track defining members of the device may require shimming or other improvisation to render them parallel to one another in the operation of the device.

One object of the present invention is to provide a shade device of the foregoing nature which does not require a frame having parallel sides and/or ends within which to mount the device. A related object is to provide a shade device of this nature wherein the device can accommodate to frames of varying width from one end and/or side thereof to the other. A further object is to provide a shade device of this nature wherein the device can be installed on whatever frame is available without improvisation, and can be installed from the low side of the frame or window, such as from within the room having the skylight. Another object is to provide a shade device of this nature wherein the shade member itself can be formed from a broad variety of materials including ones which do not have inherent stiffness and/or the ability to be self-supporting. Still another object is to provide a shade device of this nature wherein the device can be driven by a conventional cord and pulley drive mechanism, and the cords of the mechanism can be fully concealed from view below the window. Still further objects will become apparent from the description of the invention which follows hereafter.

According to the invention, the device comprises a foldably extensible and collapsible shade member, and means for forming corresponding sets of laterally projecting trunnions at spaced intervals along opposing edges of the shade member. It also comprises a pair of elongated track defining members which are adapted to be mounted on opposing sides of the window frame so that tracks thereof are oppositely disposed to one another across the frame. The track defining members have opposing sets of carrier elements slidably engaged on the respective tracks thereof, which are adapted to support the trunnions of the shade member on spaced parallel axes extending crosswise the sides of the frame. In addition, there are means for extending and retracting the shade member when the trunnions thereof are supported on the sets of carrier elements, and means whereby the respective sets of carrier elements and trunnions can reciprocate in relation to one another along the aforesaid axes when the shade member is extended and retracted thereon. In this way, the tracks of the track defining member need not be parallel to one another on the frame.

Preferably, the shade device also comprises means whereby the trunnions can be supported on the sets of carrier elements after the track defining members are mounted on the opposing sides of the window frame.

In many of the presently preferred embodiments of the invention, the carrier elements have axially extending sockets therein adapted to slidably receive the trunnions. In certain of these embodiments, moreover, the sockets have means thereon whereby the trunnions can be inserted in the same after the track defining members are mounted on the window frame. For example, in some embodiments, the sockets have slots opening laterally of the axes for insertion of the trunnions therein.

In one set of embodiments, the bodies of the carrier elements have elongated trough-like projections thereon which are adapted to cantilever relatively toward one another from the sets of carrier elements along the aforesaid axes to support the trunnions. The trough-like projections usually open generally vertically upwardly and preferably have limited flexibility so that the trunnions can be inserted in the troughs of the same through the slots at the tops thereof and snap engaged in the troughs to be slidable longitudinally thereof.

The shade member often comprises a series of hingedly interconnected panels which are individually foldable so as to be extensible and retractable into a series of V-shaped pleats that will stack at one end of the frame. In certain embodiments, the connections between panels have elongated pockets therein extending edge to edge of the shade member, and the sets of trunnions are formed by a set of elongated traverse rods which are inserted in the pockets and adapted to project beyond the opposing edges of the shade member.

In many embodiments, the extension and retraction means take the form of a conventional cord and pulley drive mechanism, the cords of which extend adjacent the track defining members and are interconnected with the sets of carrier elements to drive the shade member through the same. In some embodiments, for example, the track defining members define pairs of tracks, the sets of carrier elements are engaged in corresponding tracks of the members, and one pair of carrier elements has extensions thereon which are slidably engaged in the remaining tracks of the members, the cords of the drive mechanism being interconnected with the extensions of that one pair of carrier elements.

In one group of embodiments, the tracks for the carrier elements are defined by a pair of slotted elongated tubes, the slots of which extend lengthwise of the tubes and are defined by mutually opposing lips of the tubes. The bodies of the carrier elements have oppositely disposed but coplanar grooves therein which slidably engage with the lips of the tracks when the elements are introduced into the slots at one end thereof. The trough-like projections cantilever from the bodies of the carrier elements on perpendiculars to the planes of the grooves.

SUMMARY OF THE INVENTION

My invention is a shade device most appropriate for skylights but useable for standard windows. It consists of parallel side tracks which carry slides into which are snapped supporting rods. The supporting rods are threaded into sewn pockets in the shade material.

The shade device is operated by a continuous-loop cord and pulley system which drives the master carriers in a very precise and reliable operation. In the preferred way, the continuous-loop cord is threaded through a tensioning device causing slight tension on the system.

This allows the shade to be opened to any position at any angle without slipping back or going forward.

In addition to being a reliable mechanism, this shade device allows easy installation, particularly in hard-to-reach windows and skylights. It will operate freely even if the sides of the window or skylight frame are not perfectly parallel. There are no gaps between any parts of the device that would permit leakage of light when the shade is extended.

It is not limited to using stiff or rigid materials, but may incorporate materials of any degree of pliability.

BRIEF DESCRIPTION OF THE DRAWINGS

These features will be better understood by reference to the accompanying drawings which illustrate one of the presently preferred embodiments of the invention as it is applied to a skylight-type window.

In the drawings:

FIG. 12 is a cross-sectional view of the device along the center line of the shade member longitudinally thereof;

FIG. 13 is a similar view of the device at one of the trunnions of the shade member, showing the insertion of the same in the trough-like projection of the carrier element corresponding thereto;

FIG. 14 is a transverse cross-section of the device at the A and B ends, respectively, of the frames in FIGS. 4 and 5; and FIG. 15 is a similar view at the B and A ends, respectively, of the frames in FIGS. 4 and 5.

DESCRIPTION OF THE PREFERRED EMBODIMENT

Figure 1:
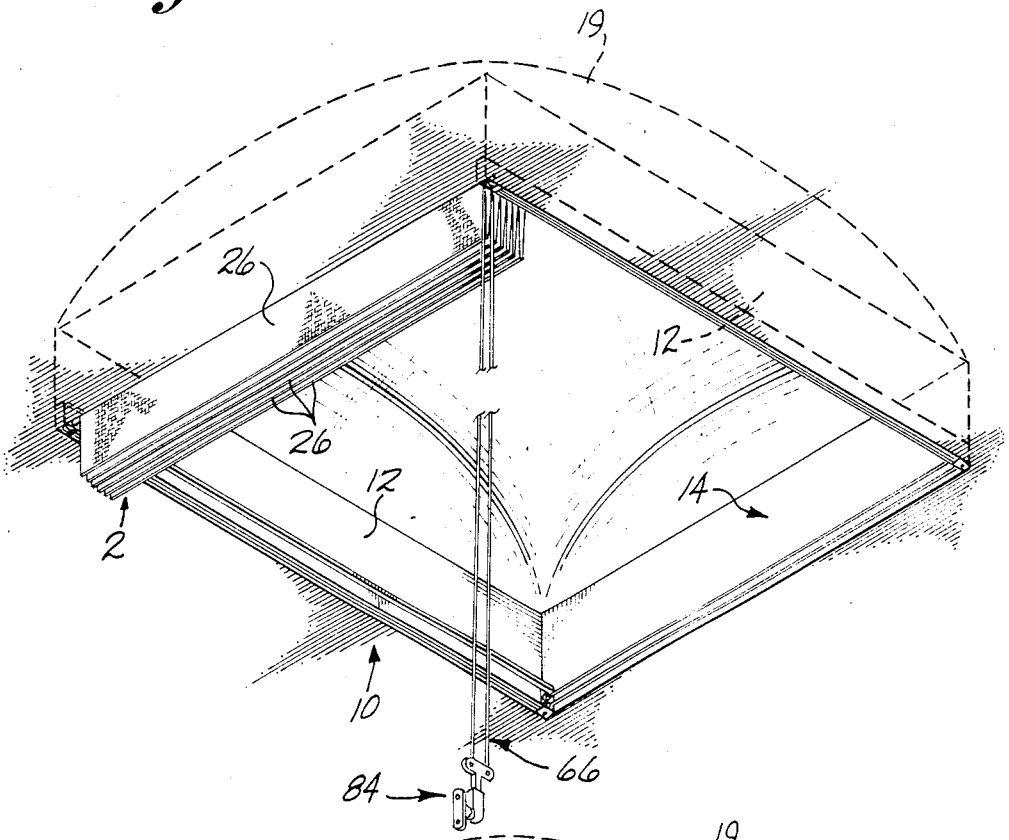
FIG. 1 is a perspective view of the skylight with the device installed on the frame thereof, but in operatively collapsed condition.
Figure 2:
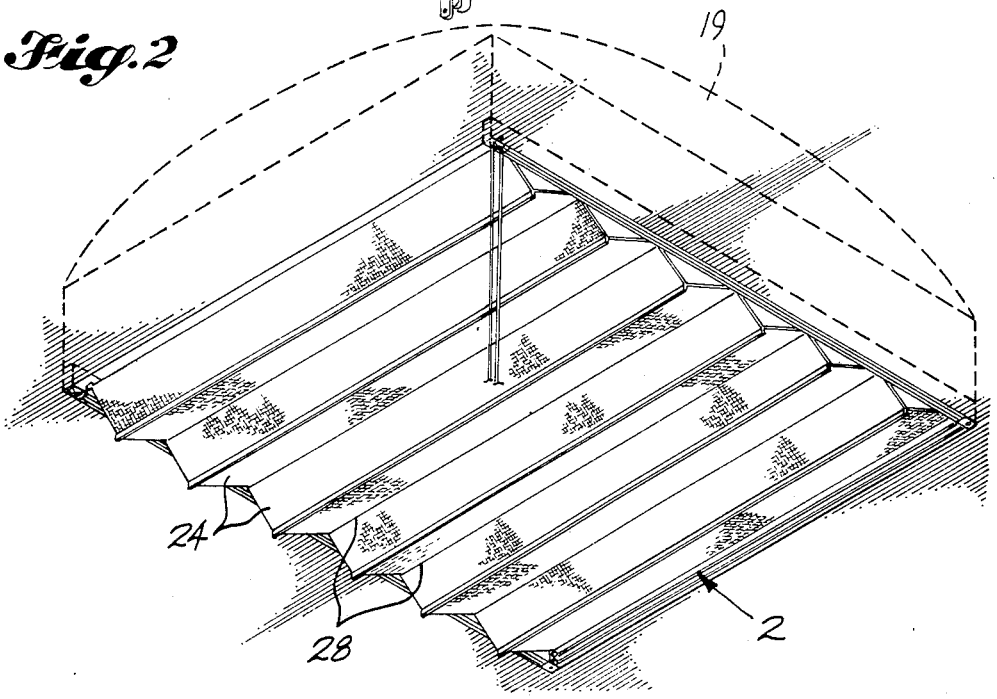
FIG. 2 is a similar view of the skylight with the device in extended condition thereon.
Figure 3:
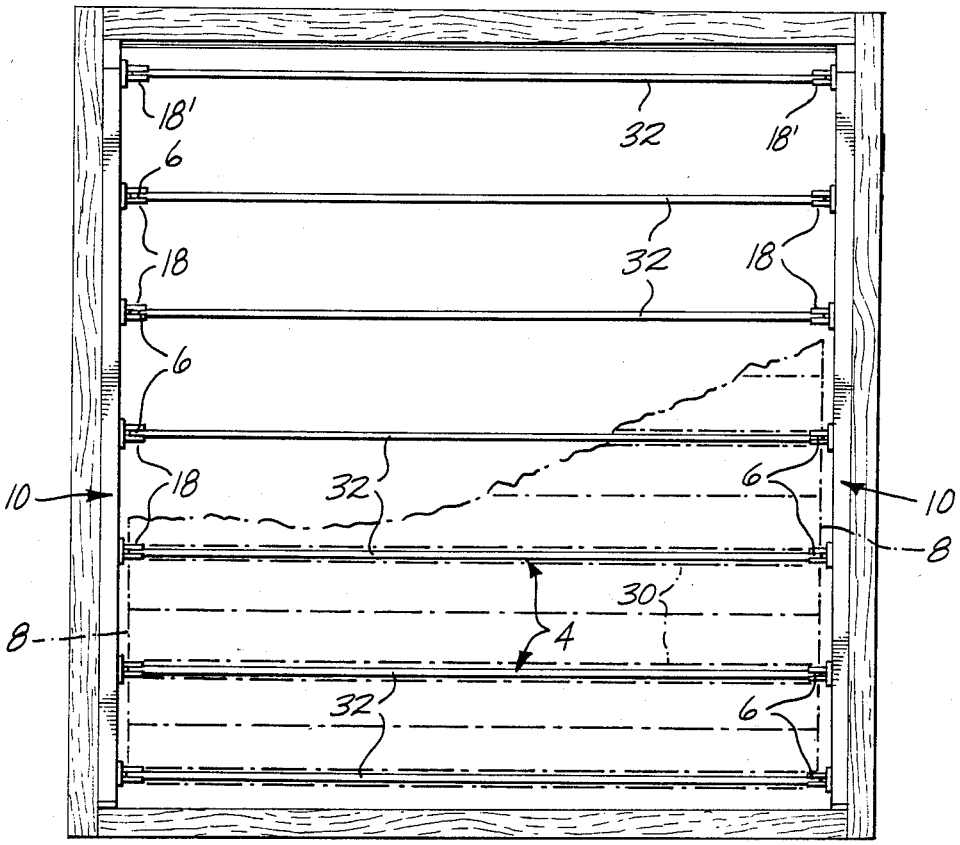
FIG. 3 is a plan view of the skylight when the shade device is installed on the frame thereof.
Figure 4:
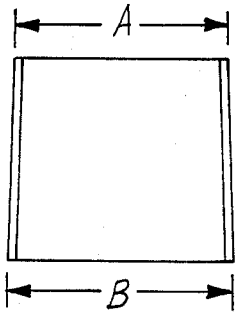
FIG. 4 is a schematic illustration of the skylight frame when it is out of parallel in one direction of the same.
Figure 5:
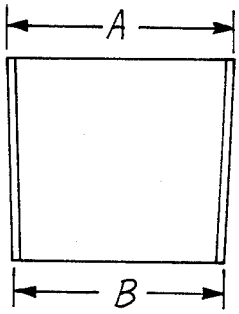
FIG. 5 is a similar illustration when the frame is out of parallel in the opposite direction.
Figures 7, 8, 9:
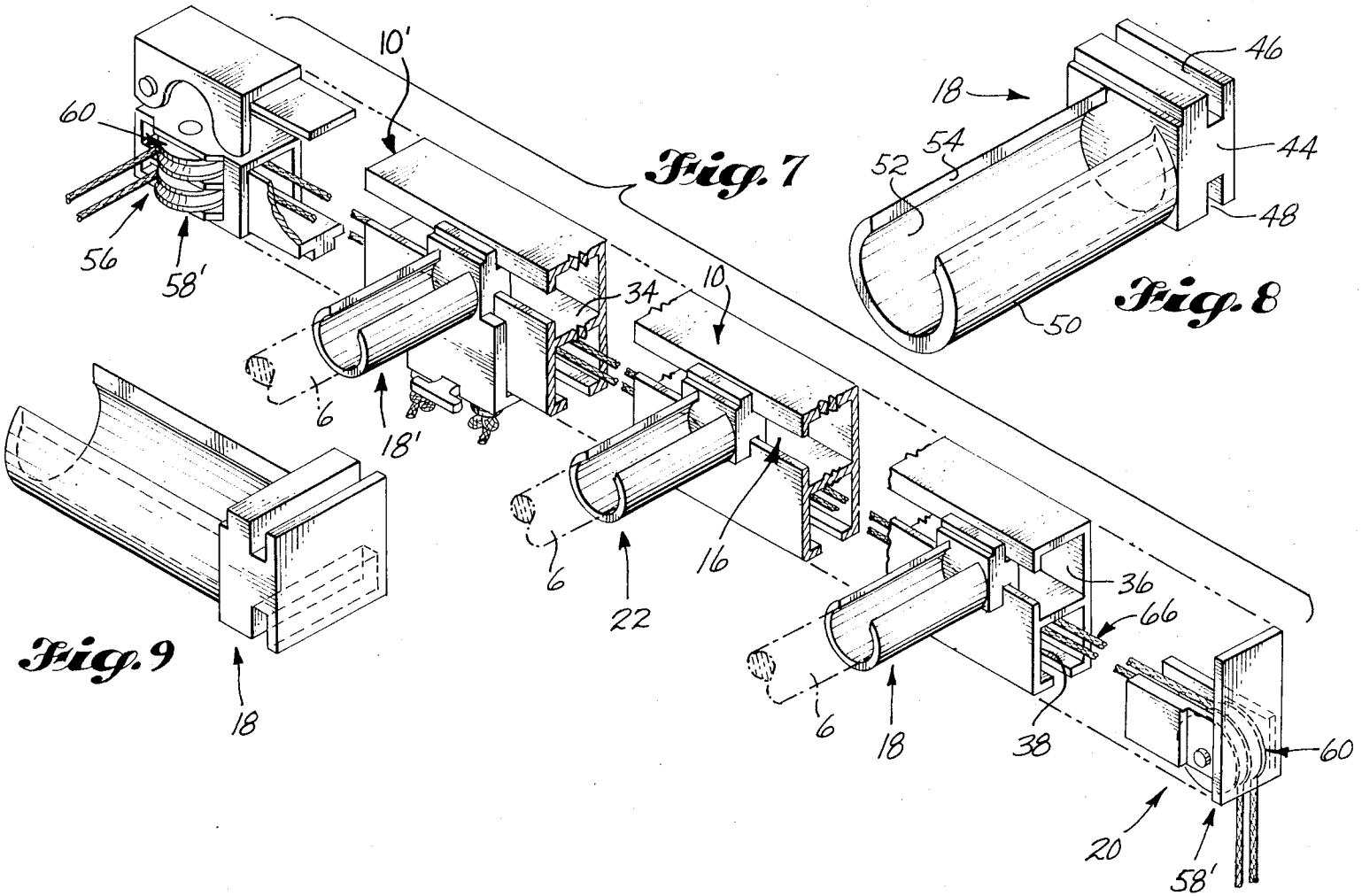
FIG. 7 is a similar view of the other side of the same.
FIG. 8 is a perspective view of a carrier element used on the respective sides of the device.
FIG. 9 is another perspective view of the carrier element.

Referring to the drawings, it will be seen that the device comprises a foldably extensible and collapsible shade member 2, and means 4 (FIG. 3) for forming corresponding sets of laterally projecting trunnions 6 at spaced intervals along opposing edges 8 of the shade member. The device also comprises a pair of elongated right and left hand track defining members 10 which have relatively inverted cross-sections and are otherwise adapted to be mounted on opposing sides 12 of the frame 14 of the skylight 19, so that tracks 16 (FIGS. 6 and 7) of the members are oppositely disposed to one another across the frame. The track defining members 10 have opposing sets of carrier elements 18 slidably engaged on the respective tracks 16 thereof, and the individual elements 18 of the tracks are adapted to be paired with one another to support opposing trunnions 6 of the shade member 2 on spaced parallel axes extending crosswise the sides 12 of the frame. In addition, there are means 20 for extending and retracting the shade member when the trunnions 6 thereof are supported on the sets of carrier elements, and means 22 which includes trunnions 6, carrier elements 18 and master carrier elements 18' (FIGS. 6 and 7) whereby the respective sets of carrier elements 18 and trunnions 6 can reciprocate in relation to one another along the aforesaid axes when the shade member is extended and retracted thereon. In this way, the tracks 16 of the track defining members need not be parallel to one another on the frame.

The shade member 2 comprises a series of hingedly interconnected panels 24 which are individually foldable so as to be extensible and retractable into a series of V-shaped pleats 26 that will stack at one end of the frame 14. The connections 28 between panels 24 have elongated pockets 30 (FIGS. 3, 14 and 15) therein extending edge 8 to edge 8 of the shade member, and the sets of trunnions 6 are formed by a set of elongated traverse rods 32 which are inserted in the pockets 30 and adapted to project beyond the opposing edges 8 of the shade member.

The panels 24 are often constructed from an inherently foldably flexible material such as fabric. However, a broad variety of other materials can be employed so long as they can be fashioned to extend and collapse in accordion-like fashion.

The track defining members 10 have rectangular tubular cross-sections and are normally mounted on the sides 12 of the frame with the tracks 16 thereof facing one another. However, the bodies of the members 10 are divided by center webs 34 which reduce them to upper and lower tubes 36 and 38, respectively, both of which are slotted to form tracks. The upper tubes 36 are slotted at their relatively inside or facing walls 40 to form the tracks 16 between the lips 40' of their respective slots. The lower tubes 38 are slotted at the bottom 42 to form tracks between the lips 42' of their respective slots.

The track defining members are preferably aluminum extrusions, but can be fashioned from other materials and/or in a different manner.

The carrier elements 18 have orthogonal block-like bodies 44 which are slightly elongated in one direction and rabbeted at the top. The bodies 44 have oppositely disposed but vertically coplanar top and bottom grooves 46 and 48 therein, which are eccentrically disposed between but parallel to the longer sides of the same. The grooves are adapted to slidably engage with the opposing lips 40' of the tracks 16 when the elements 18 are introduced to the upper tubes 36 of the members 10 at one end thereof. The bodies of the elements also have elongated, part annular or trough-like projections 50 thereon which cantilever from the opposing sides of the bodies at right angles to the planes of the grooves 46, 48. The trough-like projections 50 open generally vertically upwardly and have limited flexibility so that the trunnions 6 can be inserted in the troughs 52 of the same through the slots 54 at the tops thereof and snap-engaged in the troughs to be slidable longitudinally thereof.

Typically, the carrier elements 18 are molded from plastic material, but can be constructed in different fashion and/or from other suitable materials.

The extension and retraction means 20 comprise a conventional cord and pulley drive mechanism 56 and a pair of master carrier elements 18' which are adapted to perform as servo-drives for the shade member within the mechanism. The ends of the track defining members are capped in conventional fashion, and the caps 58 are equipped with pulleys, there being two pulleys 60 abreast in the caps 58' of one member 10' and a double pulley 62 and a single pulley 64 in the caps 58" of the other member 10". The caps bayonet into the ends of the members and place the respective pulleys in line with the lower tubes 38. The cord 66 of the mechanism 56 is roved about one of the pulleys 60 at one end of the one member 10', thence through the lower tube 38 of the member 10' and about one of the pair of pulleys 60 at the other end of the one member. The cord is then passed across the adjacent end of the frame and about one of the pulleys 62 on the adjacent end of the other member 10", where it is then passed through the lower tube of the other member to the single pulley 64 at the far end of the latter member. The cord is then looped about the single pulley and returned through the tubes 38 of the members and about the remaining pulleys 62 and 60 to a parallel with the original length of cord. Meanwhile, the outgoing and incoming lengths of cord are attached to the respective master carrier elements 18' to enable an operator to extend and retract the shade member by pulling on one or the other length of cord.

Figures 6, 10, 11:
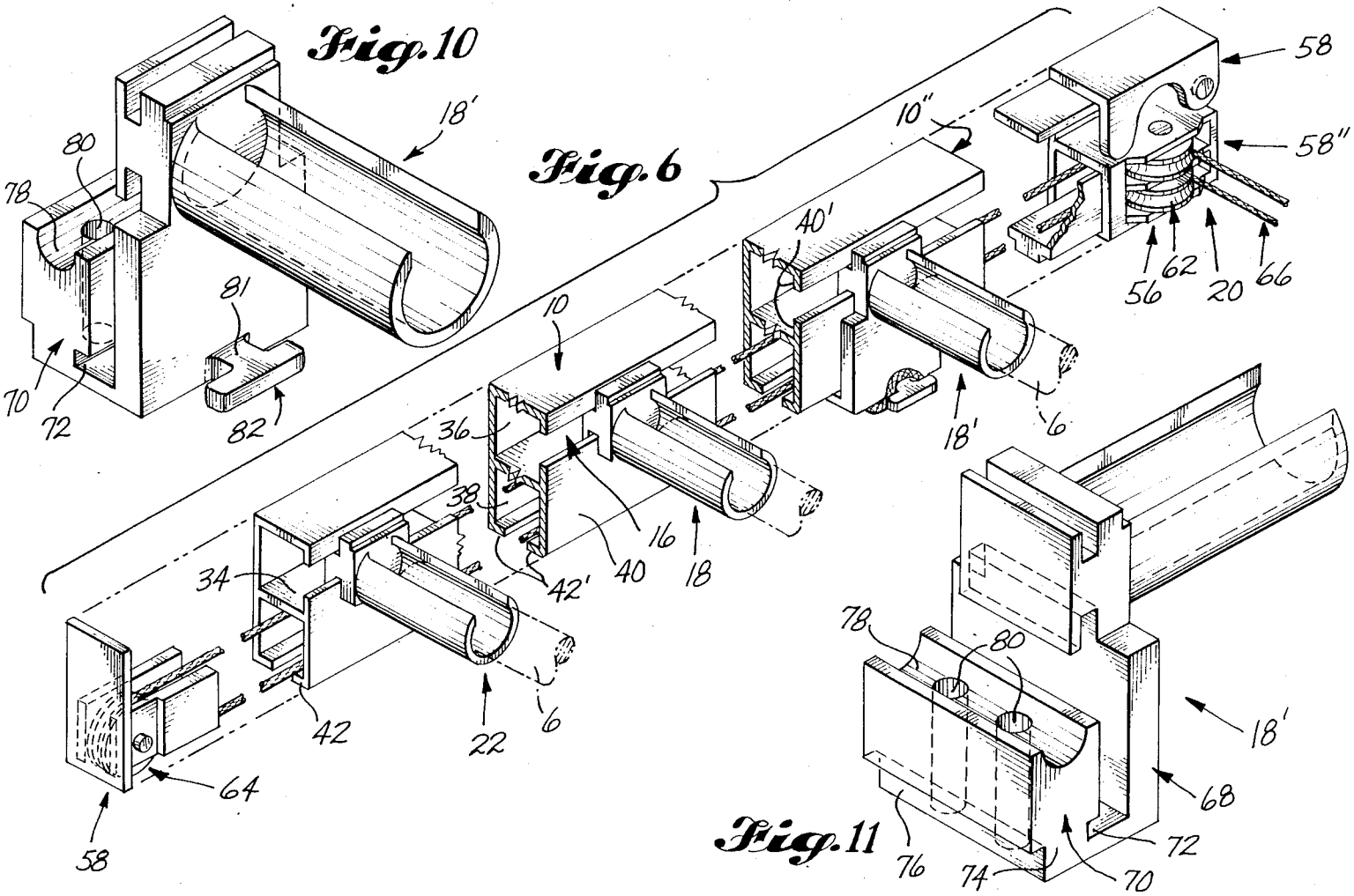
FIG. 6 is an exploded perspective view of one side of the shade device.
FIG. 10 is a perspective view of a carrier element which has been modified to lend itself to the driving of the shade member within the device.
FIG. 11 is another perspective view of the modified carrier element.

Referring now to FIGS. 10 and 11 in particular, it will be seen that the modified carrier elements, or master carrier elements 18', have bogie-like extensions 68 depending therefrom. The extensions are orthogonal and block-like, but reduced to L-shaped cross-sections with parapet-like slides 70 upstanding on the horizontal legs thereof. The slides 70 are undercut by grooves 72 along the inside faces thereof, and are rabbeted to the same height along the outside edges thereof so as to be left with elongated necks 74 between the grooves 72 and rabbets 76. The necks 74 are adapted to slidably engage between the mutually opposing lips 42' of the lower tracks when the carrier portions 18 of the master carrier elements 18' are engaged in the upper tracks 16 and the bogie-like extensions 68 are underslung below the same and engaged in the lower tracks. The slides 70 meanwhile upstand in the channels of the lower tracks, and have swale-like grooves 78 in the tops thereof which serve as guide channels for the cord lengths. The slides also have pairs of vertical holes 80 in the bottoms of the grooves, and the holes open into the bottoms of the extensions so that the lengths of cord can be passed down through holes 80, looped about the necks 81 of T-shaped cleats 82 on the bottoms of the extensions, and then passed back up through the other holes 80, and down the lengths of the channels of the respective members to the next pulley.

A tensioning device 84 is commonly used at the near end of the cord loop.

The rods 32 may be clipped to the shade member at the connections between panels, rather than engaged in pockets. Also the cord lengths 66 may be covered as they extend between the track defining members 10, such as by an inverted channel.

The term "skylight" is intended to include the roof sections of a greenhouse or the like.

What is claimed is:

1. A shade device for a skylight-type of window having a frame, comprising a foldably extensible and collapsible shade material, means for supporting the shade material comprising rods extending laterally across the width of the shade material, a pair of elongated tracks which are mounted on opposing sides of the frame so that the tracks are disposed oppositely to one another across the frame, the tracks having opposing sets of carriers that support the rods, the carriers having a base slidably engaged on the respective tracks thereof, each set comprising a master carrier and a plurality of follower carriers, the master carrier thereof being attached to a cord by which the shade material may be extended or retracted, and means by which the rods and carrier, working as a unit, adapt to variations in the distance between the two tracks.

2. The shade device according to claim 1 wherein said means by which the rod and carrier adapt to variations in the distance between two tracks comprises elongated sockets projecting from the carrier bases inwardly of the frame and parallel to the rods for slidably and rotatably receiving the ends of the rods.

3. The shade device according to claim 2 wherein slots extend along the upper side of the said elongated sockets for insertion of the rods in a snap engaging relationship.

4. The shade device according to claim 1 wherein the extension and retraction means taken the form of a continuous-loop cord and pulley mechanism, the cords of which are connected to the sets of master carriers to drive the shade material, allowing the carriers to operate precisely, and at exactly the same speed in tandem.

5. The shade device according to claim 4 whereby equal and simultaneous pressure is exerted on each of the two master carriers because of the continuous loop arrangement of the cords and pulleys.

6. The shade device according to claim 4 wherein the tracks consist of separate sections, one for the carriers and the second for housing the cord and pulley mechanism.

7. The shade device according to claim 1 wherein the rods are designed so that the shade material spans the opening between the tracks without sagging.

8. The shade device according to claim 7 wherein there are pockets sewn into the shade material to cover the rods which are inserted into the said pockets and also cover the sockets of the carriers, providing a light-tight closure.

* * * * *